United States Patent [19]

Arima

[11] Patent Number: 4,757,732

[45] Date of Patent: Jul. 19, 1988

[54] WEB SLITTING APPARATUS

[75] Inventor: Shinichi Arima, Shizuoka, Japan

[73] Assignee: Fuji Photo Film Co., Ltd., Kanagawa, Japan

[21] Appl. No.: 937,182

[22] Filed: Dec. 2, 1986

[30] Foreign Application Priority Data

Dec. 2, 1985 [JP] Japan ..... 60-269250
Dec. 16, 1985 [JP] Japan ..... 60-281199

[51] Int. Cl.[4] ..... B26D 1/24

[52] U.S. Cl. ..... 83/425.2; 83/425.3; 83/425.4; 83/430; 83/436; 83/471

[58] Field of Search ..... 83/471, 425, 425.2, 83/425.3, 425.4, 430, 436; 198/782; 226/189, 190

[56] References Cited

U.S. PATENT DOCUMENTS 833,384 10/1906 Hague ..... 83/436
1,258,599 3/1918 Moore ..... 83/430
2,014,248 9/1935 Evans ..... 83/430
2,320,659 6/1943 Sahlin ..... 83/436
2,448,934 9/1948 Van Derhoef et al. ..... 83/430
4,018,119 4/1977 Lennox ..... 83/436

*Primary Examiner*—Frank T. Yost
*Assistant Examiner*—Scott A. Smith
*Attorney, Agent, or Firm*—Young & Thompson

[57] ABSTRACT

An apparatus for slitting a web material to a desired width comprises a pair of movable frames each holding a pair of coacting upper and lower slitting edges, and a plurality of rotatable spacer rollers which are positionable selectively between the left and right slitting edges so as to support the web material being slit. The movable frames can be symmetrically moved toward and away from each other so as to adjust the distance between the left and right slitting edges to a desired width to which the web material is to be slit. In accordance with the adjusted distance, the rotatable spacer rollers can be posititioned selectively between the slitting edges, thereby supporting the web material over substantially its entire width.

10 Claims, 8 Drawing Sheets

WEB SLITTING APPARATUS

BACKGROUND OF THE INVENTION

The present invention relates to an apparatus for slitting web-like materials to a predetermined width.

There are known apparatus for slitting web-like materials such as photographic films, papers, fabrics, belt-shaped thin steel plates and the like (which are generically called web materials in this specification) to a predetermined width, which are provided with pairs of slitting means, each pair comprising upper and lower slitting edges which are mounted on a supporting frame for rotation. The supporting frames are adapted to move toward and away from each other so as to adjust the edge-to-edge distance to a predetermined width to which the web material is to be slit.

Upon being slit, the web material is carried by the lower slitting edges at both margins thereof, but it usually deflects either downward due to its own weight if it is flexible or upward if it is stiff to some degree. This deflection makes the web material be split widen a little more than intended the edge-to-edge distance, even though the equipment is adjusted to a desired width.

For preventing such lateral deflection, and to slit the web material precisely to a desired width, prior Japanese Patent Unexamined Publication No. 57-163012 teaches an apparatus provided with a pair of superposed rolls for holding down the web material, and alternately prior Japanese Utility Model Unexamined Publication No. 58-13920 teaches an apparatus provided with a pair of narrow spacers adjacent the lower slit edges.

The apparatus disclosed in these prior unexamined publications has a problem which makes it as difficult as ever to slit the web material precisely to a desired width, in particular when the web material to be slit is relatively wide. The reason is that, because either the superposed rollers or the spacers are fixed to the supporting frames or to a stationary part of the apparatus, the supported width of web material relative to the overall width thereof will be reduced as the edge-to-edge distance is increased in order to slit relatively wide web materials, and the wide web materials will deflect due to their own weight or stiffness.

OBJECTS OF THE INVENTION

It is therefore an object of the present invention to provide a web slitting apparatus which can slit a web material precisely to a predetermined width.

It is another object of the present invention to provide a web slitting apparatus which can support a web material to be slit over the whole width thereof.

It is still another object of the present invention to provide a web slitting apparatus in which a web material being slit undergoes no deflection.

SUMMARY OF THE INVENTION

In accordance with the present invention, the web slitting apparatus comprises pairs of upper and lower slitter assemblies, each pair of upper and lower slitter assemblies being mounted on a movable frame, and a plurality of rotatable spacer rollers which are positionable selectively between a pair of slitter assemblies. The pair of movable frames can be symmetrically moved toward and away from each other on a stationary base so as to adjust the distance therebetween, in other words the edge-to-edge distance between the pairs of upper and lower slitter assemblies, to be equal to the width to which a web material is to be slit. In cooperation with the movement of the movable frames, the rotatable spacer rollers are automatically and selectively positioned between the pair of slitter assemblies in accordance with the adjusted, namely the increased or the decreased, distance between the pair of movable frames so as to support the web material almost uniformly over all the width thereof.

This uniform support can prevent the web material from deflecting either upward or downward due to its own weight or its stiffness, thus allowing one to slit the web material precisely to the desired width.

BRIEF DESCRIPTION OF THE DRAWINGS

Other objects and advantages of the present invention will become apparent when the following detailed description of preferred embodiments and modifications thereof is read in conjunction with the accompanying drawings in which the same numerals are used to indicate the same section or parts in construction and function throughout the drawings and in which.

DETAILED DESCRIPTION OF THE INVENTION

Figure 1:
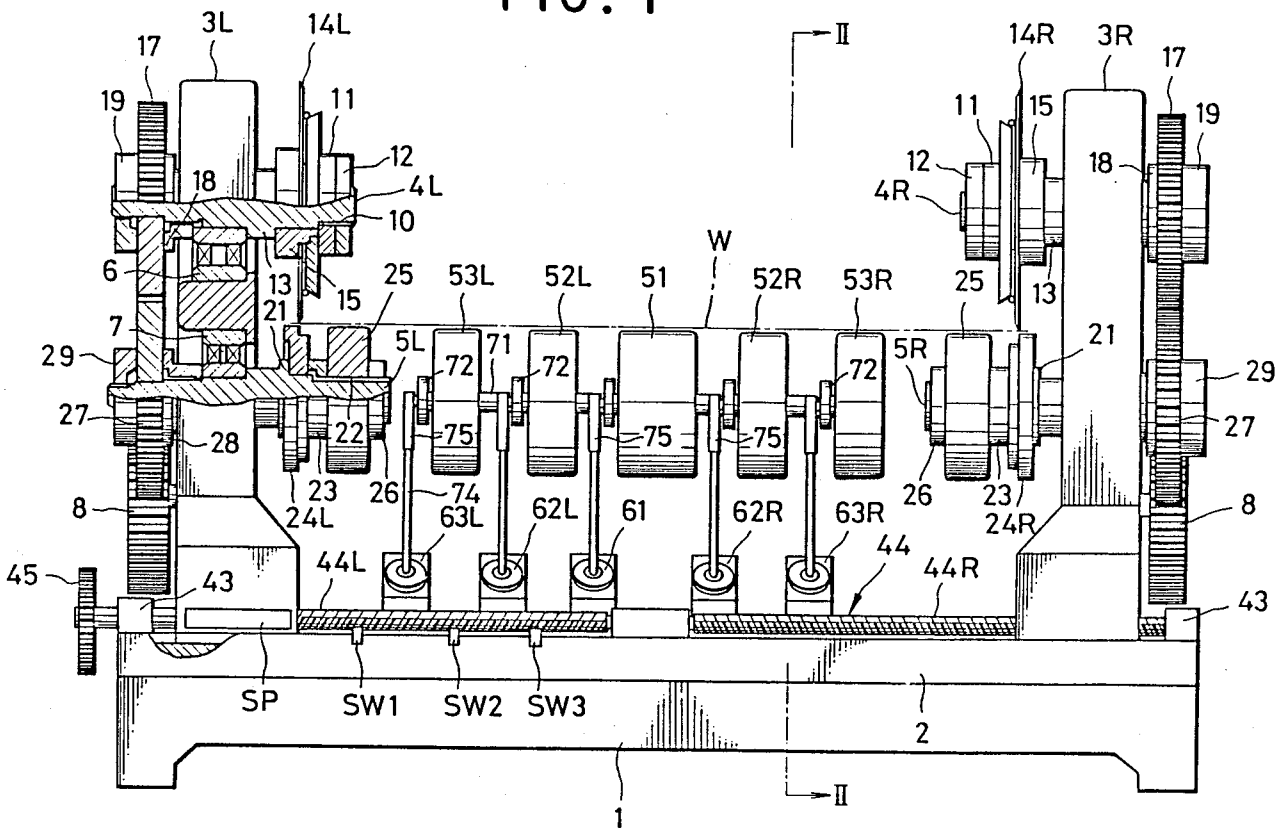
FIG. 1 is a front view, partly sectional, of the web slitting apparatus according to one embodiment of the present invention.
Figure 2:
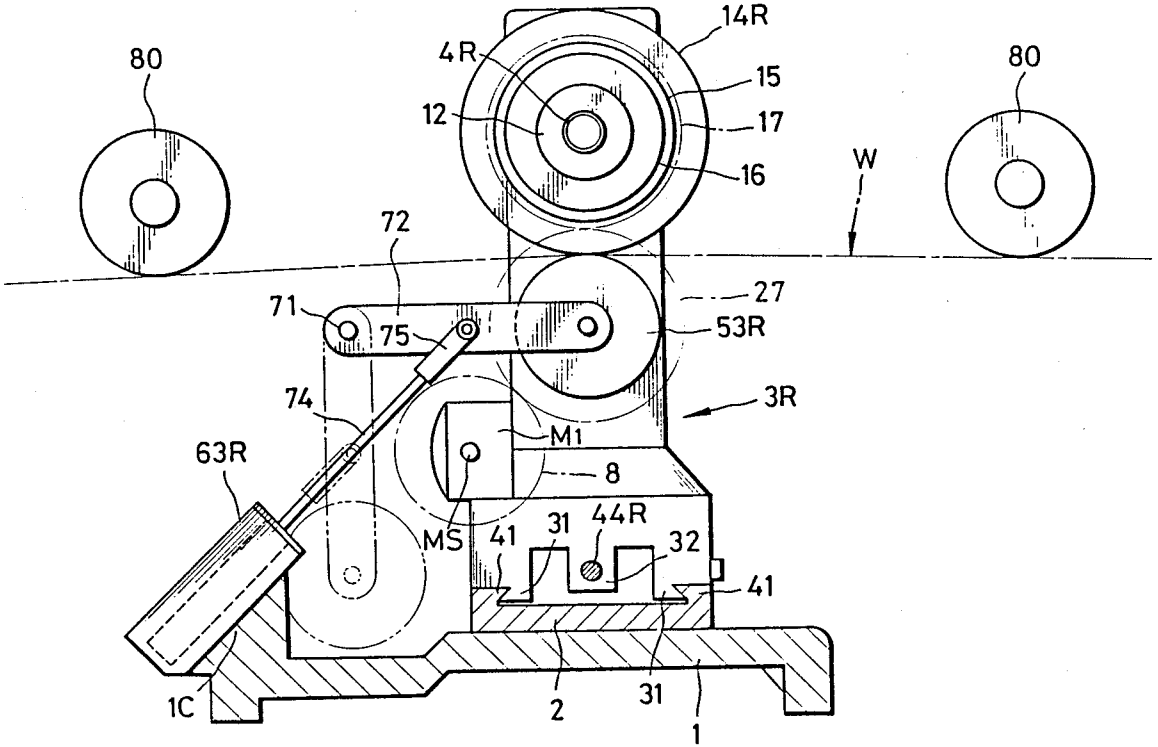
FIG. 2 is a cross sectional view of the apparatus of FIG. 1 taken along line II—II in FIG. 1.
Figure 3:
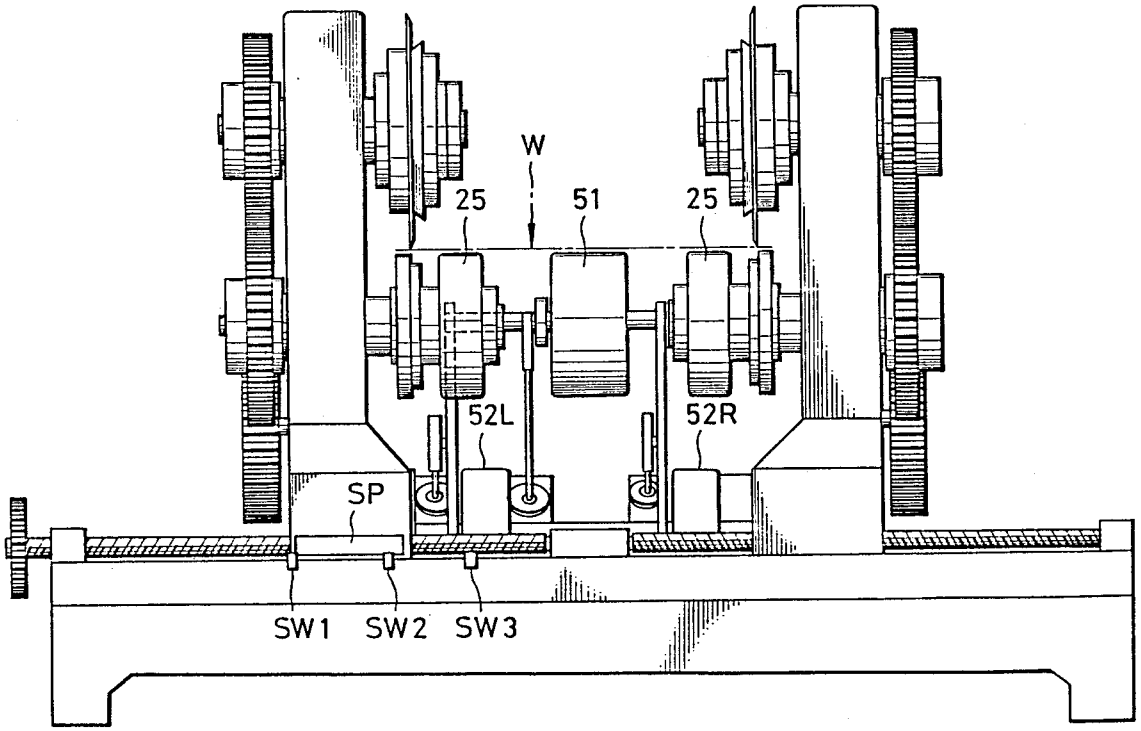
FIG. 3 is a front view similar to FIG. 1, but wherein the edge-to-edge distance has been adjusted to a narrow width.

Referring now to FIGS. 1 to 3 of the drawings, there is shown the web slitting apparatus of a preferred embodiment of the present invention which includes a pair of means for moving pairs of upper and lower slitting means toward and away from each other so as to adjust the distance between the pairs of upper and lower slitting means to a width to which a web material is to e slit, namely a left movable frame 3L and a right movable frame 3R.

These frames 3L and 3R are supported on a stationary base 1 for sliding movement toward or away from each other. Specifically, the support of each movable frame 3L, 3R is effected by means of the slidable engagement between guide rails 41 of a guide table 2 on the stationary base 1 and slide rails 31 on each frame 3L, 3R (see FIG. 2 wherein only the right side frame 3R is shown). On the left movable frame 3L a pair of rotating means, namely an upper shaft 4L and a lower shaft 5L are rotatably mounted by means of bearings 6, 7, respectively.

The upper shaft 4L is provided with a flange 13 at its middle and a threaded section 10 at its inner end. Fixed to the flange 13 by means of a nut 12 engaging with the threads of the screw 10 is an annular ring 15 which holds firmly a slitting blade 14L as the upper slitting means. By this construction, the upper shaft 4L and the slitting blade 14L comprise an upper slitter assembly. The upper shaft 4L at its outer end, that is, its end opposite the upper slitting blade 14L relative to the movable frame 3L, is provided with a transmission gear 17 fixed thereto by means of an inner spacer ring 18 and a nut 19.

The lower shaft 5L is also provided with a flange 21 at its middle and a threaded section 22 at its inner end. Between the flange 21 and a spacer ring 23 driven tightly on the screw 22, a slitting ring 24L comprising the lower slitting means is held firmly. Onto the threaded section 22 of the lower shaft 5L a nut 26 is driven tightly to fasten a spacer roller 25 fixedly on the lower shaft 5L. The thus-secured spacer roller 25 has the same diameter as the slitting ring 24L. By this construction, the slitting ring 24L, the fixed axis spacer roller 25 and the lower shaft 5L comprise a lower slitter assembly. At the outer end of the lower shaft 5L, there is a transmission gear 27 which is firmly fixed to the lower shaft 5L by means of an inner spacer 28 and a nut 29 and which meshes with the transmission gear 17.

As the same upper and lower slitter assemblies as on the left movable frame 3L are provided on the right movable frame 3R, no description will be given of the right movable frame 3R including a slitting blade 14R and a slitting ring 24R in order to avoid a repetitive description. In both instances, the same or analogous parts are denoted by the same numerals.

On each movable frame 3L, 3R, there is mounted an electric motor M1 (see FIG. 2) whose output shaft MS has a transmission gear 8 meshing with the transmission gear 27 of each lower shaft 5L, 5R. As the gear 27 is also in mesh with the gear 17 as described previously, the rotation of each motor M1 is transmitted to the upper and lower shafts 4L and 5L, 4R and 5R respectively, causing them to rotate in opposite directions at the same speed of rotation. It should be noted that there is no difference in the speed of rotation between the upper and lower shafts, and that the motors M1 of the movable frames 3L and 3R are closely synchronized so as to produce no difference in the speed of rotation of the left and right slitter assemblies. A single motor coupled to both of the gears 8 by means of any known transmission mechanism can be used in place of individual motors M.

A feed shaft 44 comprises two screw sections 44L and 44R with threads whose pitches are exactly equal but opposite. The screw sections 44L and 44R mesh with internal threads on lower portions of the movable frames 3L and 3R, respectively, so as to move the movable frames 3L and 3R in the opposite directions, namely to move them toward or away from each other upon rotation of shaft 44. The feed shaft 44 is provided with a gear 45 fixed thereto at its one end, which is operationally coupled to any known driving device (not shown), preferably a stepping motor. As the angle of rotation of the stepping motor per driving pulse is constant, the rotated angle of the feed shaft 44, and hence the advanced distance of each movable frame 3L, 3R, is proportional to the number of driving pulses applied to the stepping motor. Consequently, the distance between the left and right slitting means, more particularly the distance between the slitting edges of the left and right slitting blades 14L and 14R or of the left and right slitting rings 15L and 15R, depends on the number of driving pulses applied to the stepping motor. This means that the edge-to-edge distance between the left and right slitting means can be automatically adjusted to a width to which a web material W is to be slitted by the controlled application of driving pulses to the stepping motor.

Between the lower slitting rings 24L and 24R, there are a plurality of rotatable spacer rollers 51, 52L, 52R, 53L and 53R which are coupled to reciprocating means comprising a piston cylinder, 62L, 62R, 63L, 63R, and 61 and a swingable arm 72, respectively so as independently to be movable into or out of the space between the lower slitting rings 24L and 24R. Each rotatable spacer roller 51, 52L, 52R, 53L, 53R has the same diameter as the fixed axis spacer rollers 25 and is held in a position wherein the axis of rotation of the rotatable spacer roller is in alignment with the axis of rotation of the lower shafts 5L and 5R. Therefore, when these rotatable spacer rollers 51, 52L, 52R, 53L, and 53R are raised and positioned between the lower slitting rings 24L and 24R, all of the spacer rollers, namely the fixed axis spacer rollers 25 and the swingable spacer rollers 51, 52L, 52R, 53L and 53R, can support the web material W horizontally from below along a line common to the peripheries thereof, keeping the same from sagging or deflecting downwardly. Although in this embodiment, the swingable spacer rollers 52L, 52R, 53L and 53R are illustrated as having the same width, but narrower than the width of the center swingable spacer roller 51, the width and the number of the swingable spacer rollers including the center one may be varied.

The swingable spacer rollers 51, 52L, 52R, 53L and 53R are selectively and independently retractable. For the retraction of each rotatable spacer roller, there is provided, as is shown for example in FIG. 2 for the spacer roller 53R, a swinging device comprising the hydraulic cylinder 63R having a reciprocating piston 74 with a joint head 75, and the swingable arm 72 which is supported on a common stationary shaft 71 for pivotal movement and connected to the joint head 75 at its middle. The swingable arm 72 further supports the swingable spacer roller 53R at its free end for free rotation. The hydraulic cylinder 63R is mounted at an angle on a rear section 1C of the stationary base 1. It should be noted that the reciprocating piston 74 has a predetermined reciprocating stroke to swing the spacer roller 53R up so as to align the axis of rotation of the roller 53R with the axis of the lower shafts 3L and 3R as described previously.

These swingable spacer rollers 51, 52L, 52R, 53L and 53R are selectively positioned or removed from between the fixed axis spacer rollers 25 in connection with the movement of the movable frames 3L and 3R toward or away from each other. As shown in FIG. 1, when the left movable frame 3L is in any position between its outermost position and a first position where a long and narrow projection SP on one side of the left movable frames 3L is just ready to contact, but not to actuate, a first limit switch SW1, all the hydraulic cylinders 61, 62L, 62R, 63L and 63R hold the reciprocating pistons 74 extended so as to raise the swingable spacer rollers 51, 52L, 52R, 53L and 53R, and to maintain them between the fixed axis spacer rollers 25 with their axes of rotation aligned with the axis of the lower shafts 5L and 5R.

Upon movement of the frames 3L and 3R toward each other for adjusting the distance between the left and right slitting blades, when the projection SP is brought into contact with the first limit switch SW1 and causes it to turn ON, the hydraulic cylinders 63L and 63R are caused to retract their pistons 74, swinging the arms 72 down through an angle of 90° so that the swingable spacer rollers 53L and 53R are swung down from between the fixed axis spacer rollers 25 to a position as is shown by a double dotted line in FIG. 2. However, the remaining spacer rollers 51, 52L and 52R are maintained raised until the left movable frame 3L reaches a position wherein the projection SP is just ready to contact, but not to actuate, a second limit switch SW2.

For reducing further the distance between the left side and right side slitting blades, the shaft 44 is further rotated, and when the projection SP is brought into contact with the second limit switch SW2 and causes it to turn ON as shown in FIG. 3, the hydraulic cylinders 62L and 62R are caused to retract their pistons 74, swinging the associated arms 72 down so that the spacer rollers 52L and 52R are swung down from between the fixed axis spacer rollers 25. As a result, the web material W is then supported by the swingable spacer roller 51 and the fixed axis spacer rollers 25 and kept flat without sagging or deflecting.

In the same way as described for the spacer rollers 53L–53R, 52L–52R, when the distance between the left side and right side slitting blades is further reduced by moving the movable frames 3L and 3R closer to each other and a third limit switch SW3 is actuated by the projection SP, the hydraulic cylinder 61 is caused to retract its piston 74, swinging the spacer roller 51 down from between the fixed axis spacer rollers 25. As a result, the web material W is then supported only by the fixed axis spacer rollers 25 to be kept flat without sagging or deflecting.

As will be apparent from the foregoing, the swingable spacer rollers 51, 52L, 52R, 53L and 53R are swung down from between the fixed axis spacer rollers 25 symmetrically from the outside in several steps into which the distance between the left and right slitting blades is notionally divided. Consequently, when the movable frames 3L and 3R are moved toward each other to adjust the distance between the left and right slitting blades to the width of a web material to be slit, the rotatable spacer rollers are symmetrically lowered from between the stationary rollers 25, leaving as many rotatable rollers as are required to support the web material W uniformly over almost its entire width. On the other hand, when the movable frames 3L and 3R are moved away from each other to increase the distance between the left side and right side slitting blades, conversely, the rotatable spacer rollers 51, 52L, 52R, 53L and 53R are raised and positioned between the stationary spacer rollers 25 symmetrically from the center, stepwise, in accordance with the increased distance. Shown at 80 in FIG. 2 are guide rollers for stabilizing the travel of the web material.

It is permissible to use a cylinder actuating device operationally cooperating with the feed shaft 44 for controlling the retractive operation of the hydraulic cylinders 61, 62L, 62R, 63L and 63R so as to raise or lower the spacer rollers 51, 52L, 52R, 53L and 53R, in place of the first to third limit switches SW1 to SW3. For example, the hydraulic cylinders 61, 62L, 62R, 63L and 63R may be selectively controlled in accordance with the number of driving pulses applied to the stepping motor coupled to the feed shaft 44, because, as previously described, the distance moved by the frames 3L and 3R is proportional to the number of driving pulses applied to the stepping motor.

Figure 4:
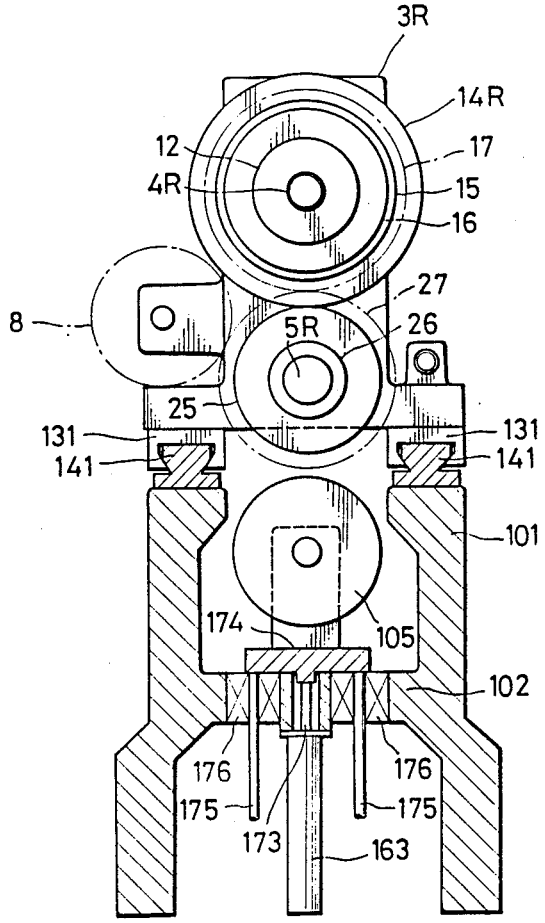
FIG. 4 is a cross sectional view similar to FIG. 2 of the web slitting apparatus according to another embodiment of the present invention.

Referring to FIG. 4, there is shown therein another embodiment of the present invention wherein the left and the movable frames and the left and right pairs of upper and lower slitting means are the same in construction and function as those shown in FIGS. 1 to 3 and are therefore denoted by the same numerals for avoiding the repetition of description. In this embodiment, in order to accommodate a plurality of rotatable spacer rollers 105, there is provided an H-shaped stationary base 101 at the top of which a pair of guide rails 141 are disposed for slidably mounting the left and right movable frames 3L and 3R by their slide rails 131. In the space inside the H-shaped stationary base 101 there are a plurality of spacer rollers 105 arranged in a row which are similar to those shown in FIGS. 1 to 3. Each rotatable spacer roller 105 is mounted on a holding head 174 which is secured to a reciprocating device for vertical reciprocating motion.

The reciprocating device comprises a hydraulic cylinder 163 vertically secured to a partition wall 102 of the H-shaped stationary base 101 and a piston 173 to which the holding head 174 is secured. The holding head 174 is provided with two downwardly extending guide rods 175 which are slidably guided by guide members 176 so as to maintain the vertical movement of the holding head 174, and hence the rotatable spacer roller 105. Each hydraulic cylinder can be controlled to raise and lower the associated rotatable spacer roller between the fixed axis spacer rollers 25 in the same way as described for the web slitting apparatus shown in FIGS. 1 to 3.

Figure 5:
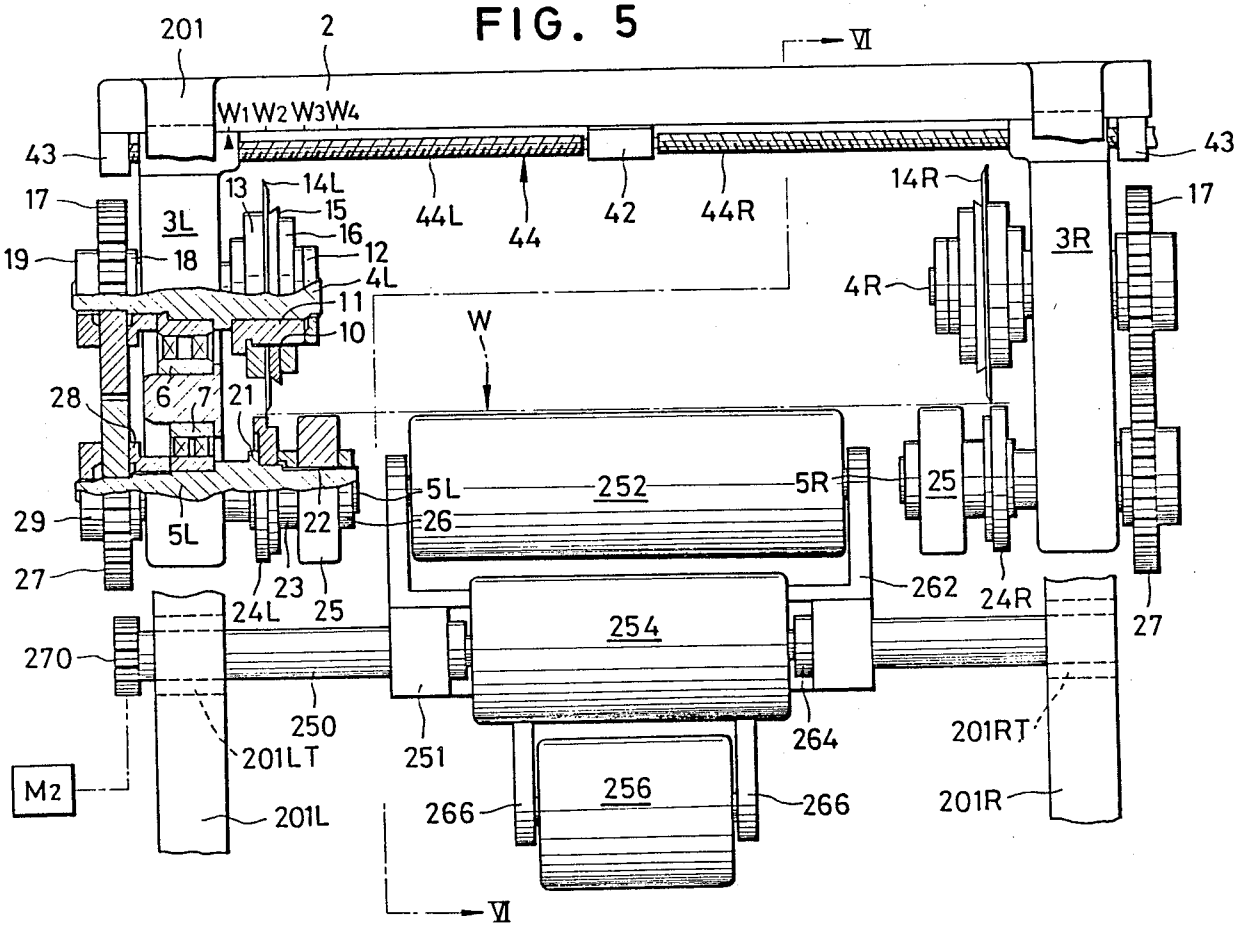
FIG. 5 is a front, partly sectional view similar to FIG. 1 of the web slitting apparatus according to still another embodiment of the invention.
Figure 6:
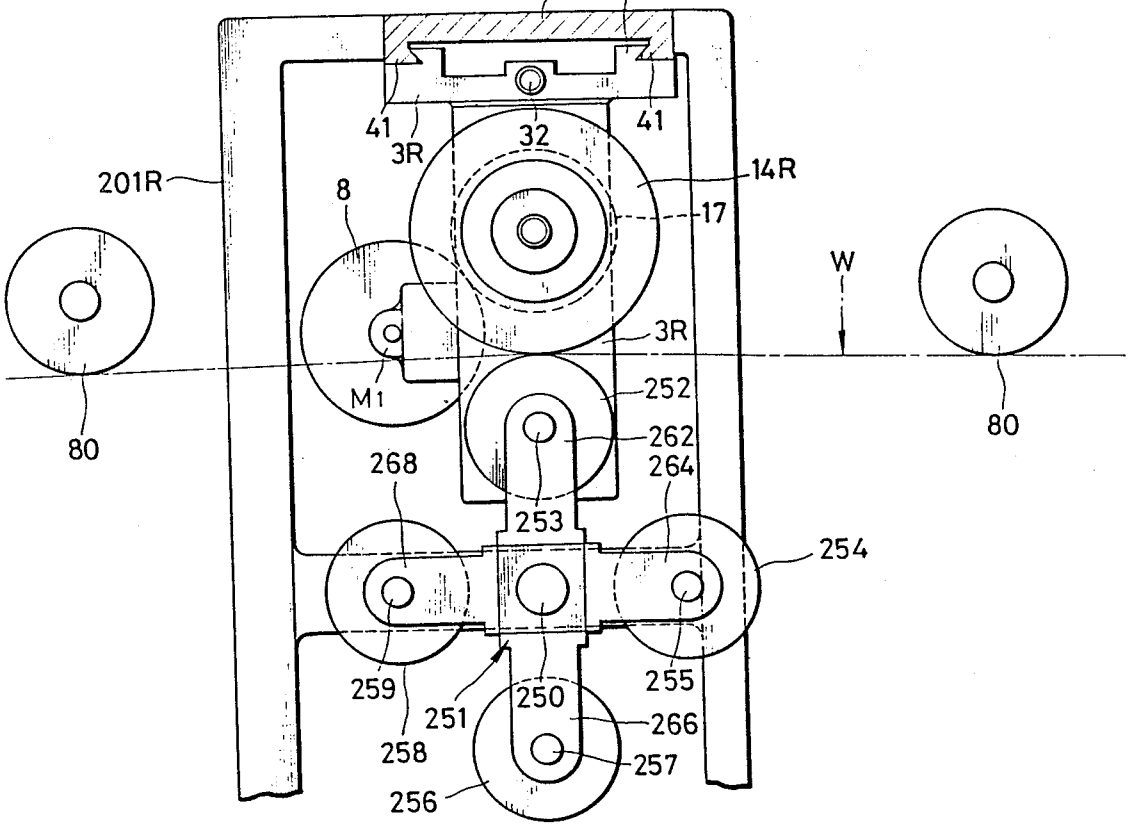
FIG. 6 is a cross sectional view of the apparatus of FIG. 5 taken along line VI—VI in FIG. 5.

FIGS. 5 and 6 show the web slitting apparatus of another preferred embodiment in accordance with the present invention which is much the same in construction as the apparatus shown in FIGS. 1 to 3 except that an interchangeable spacer roller assembly is provided inside the apparatus and that the left and movable frames are slidably suspended from the extended top of a stationary base of the apparatus so as to accommodate the interchangeable spacer roller assembly inside the apparatus. Therefore, the same parts and members are denoted by the same numerals for avoiding the repetition of description.

A stationary base 201 comprises a pair of H-shaped base frames 201L and 201R. Between the base frames 201L and 201R there is a guide table 2 fixed thereto upside down for suspending the movable frames 3L and 3R for sliding movement.

The interchangeable spacer roller assembly includes a plurality of, for example four in this embodiment, rotatable spacer rollers 252, 254, 256 and 258 having the same diameter as the fixed axis spacer rollers 25 and lengths different from one another. Each rotatable spacer roller 252, 254, 256, 258 is mounted on a shaft 253, 255, 257, 259 supported between a pair of arms 262, 264, 266, 268 of a cruciform frame 251 which is fixed to a rotary shaft 250 supported between the cross beams 201L and 201R. The arms 262 to 268 of each frame 251 are at right angles to one another. As shown in FIG. 6, the rotatable spacer rollers 252 to 258 have lengths that decrease in steps and are arranged in order of length. The axes of rotation of the shafts 253 to 259 lie on a cylinder coaxial with the axis of rotation of the rotary shaft 250 and a radius equal to the distance between the axis of rotation of the rotary shaft 250 and the lower shaft 5L, 5R.

At one end of the rotary shaft 250 there is a transmission gear 270 which is coupled through a gear train (shown by a chain line) to a stepping motor M2 adapted to turn the rotary shaft 250 by an angle of 90° so as to position either one of the rotatable spacer rollers 252 to 258 between the fixed axis spacer rollers 25 with its axis of rotation aligned with the axis of the lower shafts 5L and 5R. It is desirable to adapt the motor M2 to cooperate with the movement of the movable frames 3L and 3R, namely with the adjustment of the distance between the slitting blades of the upper or lower slitting means to a width to which the web material W is to be slit.

The web slitting apparatus constructed above is operated in the same way as the previously described embodiment. When the movable frames 3L and 3R are moved from their outermost or the first position W1, and the second position W2, the longest rotary spacer roller 252 is raised and held between the fixed axis spacer rollers 25. At the moment when the movable frame 3L reaches the second position W2, the stepping motor M2 is actuated to turn the rotary shaft 250 through an angle of 90°, thus positioning the rotatable spacer roller 254 between the fixed axis spacer rollers 25 simultaneously with removing the rotatable spacer roller 252 previously positioned there. Until the movable frame 3L reaches the third position W3, the rotary spacer roller 254 is held between the fixed axis rollers 25.

In the same way as described above, every time the movable frame 3L reaches the predetermined position W3, W4, the stepping motor M2 is caused to turn the rotary shaft 250 through an angle of 90°, thus positioning a shorter rotary spacer roller 256, 258 between the fixed axis spacer rollers 25. When the movable frames 3L and 3R are moved away from each other, the stepping motor M2 is rotated in the reverse direction so as to position a longer rotatable spacer roller than that previously positioned between the fixed axis spacer rollers 25 in the reverse order.

It is also desirable to this embodiment to move the left and right movable frames 3L and 3R by an electric motor operationally coupled to the feed screw shaft 44 so as to adjust automatically the distance therebetween in accordance with the width to which the web material is to be slit. In this case, it is possible to position automatically the needed one of the rotatable spacer rollers 252 to 258 in cooperation with the automatic adjustment of the distance between the left and right movable frames 3L and 3R, namely between the slitting edges of the upper slitting blades 14L and 14R or of the lower slitting rings 15L and 15R, by operationally coupling the motor M2 of the rotary shaft 250 to the electric motor of the feed shaft 44.

Figure 7:
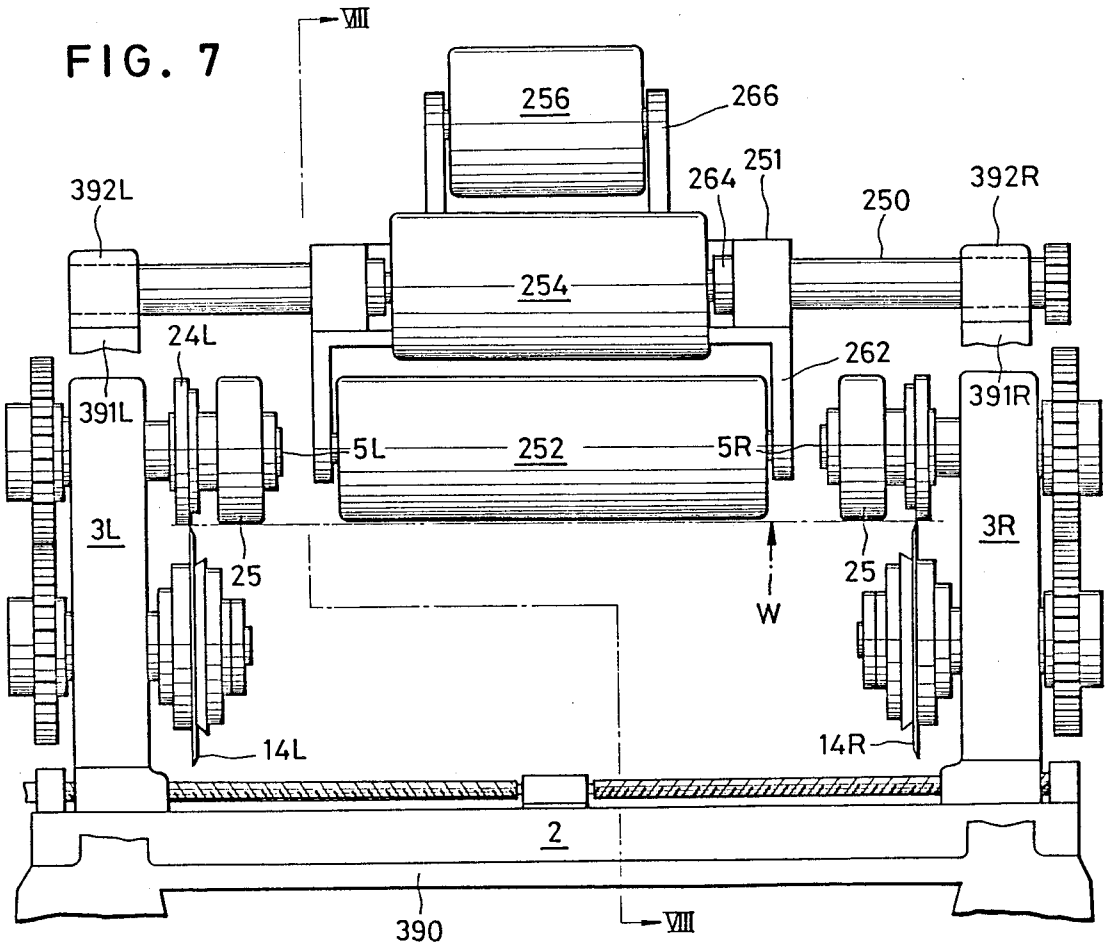
FIG. 7 is a front view of the web slitting apparatus according to a further embodiment of the present invention.
Figure 8:
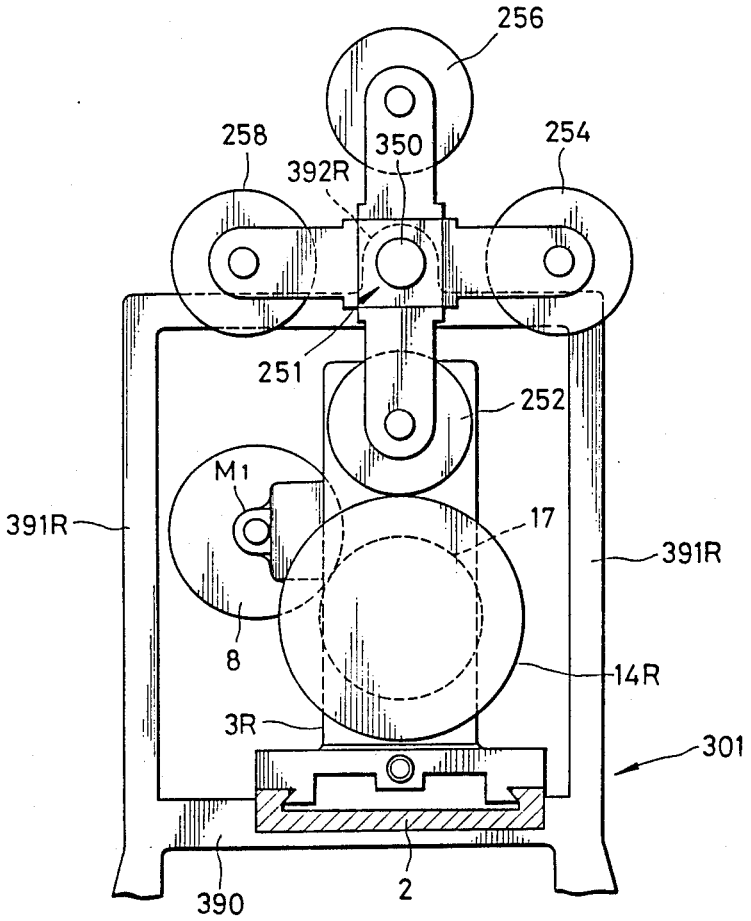
FIG. 8 is a cross sectional view of the apparatus of FIG. 7 taken along line VIII—VIII in FIG. 7.

Referring now to FIGS. 7 and 8, there is shown therein the web slitting apparatus of still another embodiment of the present invention which has the same construction as the previous one shown in FIGS. 5 and 6 except that the left and right movable frames 3L and 3R are slidably mounted on the guide table of the stationary base and that the interchangeable spacer roller assembly is so disposed as to hold the web material down by contact with its upper surface.

The guide table 2 is fixed between cross beams 390 of the stationary base 301 for mounting thereon the left and right movable frames 3L and 3R for sliding movement. The upper and lower slitting assemblies mounted on each frame 3L, 3R, are, however, reversed in location. For this reason, the stationary spacer rollers 25 are located just above the web material W. An interchangeable spacer roller assembly as in FIGS. 5 and 6 is disposed above the web material W. For this purpose, there are a pair of bearings 392L and 392R mounted on cross beams of extended frames 391L and 392R of the stationary base 390 for supporting the ends of the rotary shaft 350. Therefore, the rotatable spacer rollers 252 to 258 having different lengths are positioned in the order of their length between the stationary spacer rollers 25, stepwise in accordance with the increased or decreased distance between the left and right slitting discs, so as to hold down uniformly the web material by contact with its upper surface. This construction of the apparatus is advantageous for slitting stiff web materials which are apt to deflect upward when they are slit.

In accordance with the web slitting apparatus of the present invention, the web material can be supported uniformly over almost all its width by the fixed axis spacer rollers incorporated with the pair of slitting means and selectively positioned rotatable spacer rollers, the web material being prevented from sagging or deflecting due to its own weight or stiffness. The selective positioning of rotatable spacer rollers can be automatically performed in cooperation with the movement of the movable frames toward or away from each other for adjusting the edge-to-edge distance of the pairs of upper and lower slitting means to the width to which the web material is to be slit. As a result, the web slitting apparatus of this invention can slit web materials precisely to a desired width, not only according to whether the web materials are wide or narrow, but also according to whether the web materials are apt to deflect due to their own weight or stiffness.

Because certain changes may be made in the above-described web slitting apparatus without departing from the scope of the present invention, it is intended that all matter contained in the above description or shown in the accompanying drawings shall be interpreted as illustrative and not limiting.

What is claimed is:

1. An apparatus for slitting a web material to a desired width which includes pairs of upper and lower slitting means, said apparatus comprising;

means for moving said pairs of upper and lower slitting means toward and away from each other so as to adjust the distance between said pairs of upper and lower slitting means to said width;

a plurality of spacer rollers for supporting said web material;

means for supporting said spacer rollers independently for rotation; and means for actuating said spacer roller supporting means to position selectively said spacer rollers either between one of said pairs of upper and lower slitting means or out of the path of said one pair of slitting means as said pairs of slitting means approach each other, thereby holding said web material flat over almost all said width by varying the number of spacer rollers that support said web material directly as the distance between said pairs of slitting means.

2. An apparatus as defined in claim 1, wherein said moving means comprise a pair of frames each of which supports said pair of upper and lower slitting means and which are adapted to be moved continuously and symmetrically so as to change linearly the distance therebetween, and said actuating means actuating said spacer roller supporting means to position selectively said spacer rollers between said pairs of upper and lower slitting means in accordance with the moved distance of said pair of frames.

3. An apparatus as defined in claim 2, further comprising a spacer roller rotatably mounted on each of said frames for supporting the margin of said web material.

4. An apparatus as defined in claim 2, wherein said spacer roller supporting means comprises a plurality of reciprocating means arranged side by side and each of which supports one of said spacer rollers.

5. An apparatus as defined in claim 4, wherein said reciprocating means are adapted to be actuated bilaterally symmetrically.

6. An apparatus as defined in claim 4, wherein said reciprocating means includes a hydraulic cylinder.

7. An apparatus as defined in claim 2, wherein said spacer rollers have lengths different from one another.

8. An apparatus for slitting a web material to a desired width which includes pairs of upper and lower slitting means, said apparatus comprising;

means for moving said pairs of upper and lower slitting means toward and away from each other so as to adjust the distance between said pairs of upper and lower slitting means to said width;

a plurality of spacer rollers for supporting said web material;

means for supporting said spacer rollers independently for rotation; and means for actuating said spacer roller supporting means to position selectively said spacer rollers between one of said pairs of upper and lower slitting means in accordance with said adjusted distance, thereby holding said web material flat over almost all said width, said spacer rollers having lengths different from one another, said spacer roller supporting means comprising a rotatable shaft for supporting said spacer rollers separately for bodily movement about a circle with its center at the axis of rotation of said rotatable shaft.

9. An apparatus as defined in claim 8, wherein said spacer rollers are spaced apart by equal angles in the order of their length.

10. An apparatus as defined in claim 8, wherein said rotatable shaft is rotated by an electric motor whose angle of rotation is proportional to the moved distance of said frames.

* * * * *